US007465021B2

(12) United States Patent
Toge et al.

(10) Patent No.: US 7,465,021 B2
(45) Date of Patent: Dec. 16, 2008

(54) LIQUID-DISCHARGING RECORDING HEAD AND LIQUID-DISCHARGING RECORDING APPARATUS HAVING THE HEAD

(75) Inventors: Yoshiyuki Toge, Yokohama (JP); Yoshiyuki Imanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 431 days.

(21) Appl. No.: 11/399,845

(22) Filed: Apr. 7, 2006

(65) Prior Publication Data

US 2006/0232628 A1 Oct. 19, 2006

(30) Foreign Application Priority Data

Apr. 14, 2005 (JP) ..... 2005-116666

(51) Int. Cl.
*B41J 2/14* (2006.01)
*B41J 2/175* (2006.01)

(52) U.S. Cl. ..... 347/50; 347/87

(58) Field of Classification Search ..... 347/50, 347/58, 87; 361/748, 349
See application file for complete search history.

(56) References Cited

U.S. PATENT DOCUMENTS 5,506,611 A 4/1996 Ujita
6,000,773 A * 12/1999 Murray et al. ..... 347/7
6,074,041 A * 6/2000 Imanaka et al. ..... 347/50
6,227,643 B1 * 5/2001 Purcell et al. ..... 347/19
6,231,155 B1 5/2001 Udagawa et al.
6,536,871 B1 * 3/2003 Haddick et al. ..... 347/50
6,641,254 B1 * 11/2003 Boucher et al. ..... 347/50
6,648,445 B2 * 11/2003 Ishizawa et al. ..... 347/19
7,258,431 B2 * 8/2007 Shinada et al. ..... 347/86

FOREIGN PATENT DOCUMENTS

CN 1141241 1/1997
JP 3-126560 A 5/1991
JP 7-060953 A 3/1995
JP 3438683 B 6/2001

* cited by examiner

*Primary Examiner*—Anh T. N. Vo
(74) *Attorney, Agent, or Firm*—Canon USA Inc. IP Div

(57) ABSTRACT

In a liquid-discharging recording head, external-signal input terminals are provided on a recessed first face and a second face that is higher than the first face. ID contact pads directly connected to information storage elements provided in the liquid-discharging recording head are arranged in a row on the first face along the border with the second face.

2 Claims, 7 Drawing Sheets

LIQUID-DISCHARGING RECORDING HEAD AND LIQUID-DISCHARGING RECORDING APPARATUS HAVING THE HEAD

BACKGROUND OF THE INVENTION

1. Field of the Invention

The present invention relates to a liquid-discharging recording head (inkjet recording head) that performs recording by discharging liquid such as ink (hereinafter simply referred to as ink), and a liquid-discharging recording apparatus (inkjet recording apparatus) including the head.

2. Description of the Related Art

In recent inkjet recording apparatuses, a detachably loaded inkjet recording head has readable information (individual information) inherent thereto, such as an ID (identity) code and driving characteristics for an ink discharging mechanism. For example, this allows the inkjet recording apparatuses to acquire information about the loaded inkjet recording head, and to execute driving control best suited for ink discharging from the head. For that purpose, a ROM (read only memory) mounted on an inkjet recording substrate is known. Japanese Patent Laid-Open No. 3-126560 (corresponding to U.S. Pat. No. 6,231,155) discloses that an EEPROM (electrically erasable programmable ROM) is mounted.

It is also known that a base substrate of an inkjet recording substrate in an inkjet recording head is provided with a resistor indicating information inherent in the recording head, together with a layer that forms an ink discharging mechanism. In this case, the inkjet recording apparatus can acquire information about the loaded inkjet recording head by reading the value of the resistor provided on the base substrate. This method is effective when the amount of information is relatively small.

Japanese Patent No. 3438683 discloses that, when a layer that forms an ink discharging mechanism is formed on a base substrate of an inkjet recording substrate, fuses serving as ROMs are simultaneously formed. The fuses are selectively blown out by using, for example, a logic circuit, thereby writing and storing binary data.

When a detachable inkjet recording head is loaded in the recording apparatus, it is inevitably touched with the hand of the user. In this case, there is a risk that electric terminals of the head for connection to the recording apparatus will be affected by static electricity. In an inkjet recording head disclosed in Japanese Patent Laid-Open No. 7-060953 (corresponding to U.S. Pat. No. 6,074,041), a discharging circuit is provided around contact pads that establish electrical connection to the main unit of an inkjet recording apparatus in order to protect the head from such static electricity.

However, in the inkjet recording head in which an information storage element, such as a ROM or an EEPROM, is mounted, as disclosed in Japanese Patent Laid-Open No. 3-126560, the configuration of the apparatus is inevitably complicated. Therefore, there are demands to increase productivity and to reduce the size and weight of the head. Basically, a ROM chip is useful when the volume of recording data is high. However, when the volume of recording data is not high, the ROM chip is sometimes disadvantageous in cost, and there is a need to improve this disadvantage.

In contrast, in the method in which elements for storing information inherent in the head are formed in the layer forming process, it is possible to prevent the configuration of the head from being complicated and to prevent the number of processes from increasing in order to store the inherent information. For this reason, a small and light head having individual information can be provided with a simple configuration and at low cost without reducing productivity.

In this inkjet recording head that can store individual information, it is particularly important to give consideration to static electricity. That is, fine information storage elements provided on the inkjet recording substrate to store information inherent in the head are not resistant, particularly, to static electricity. Therefore, the information storage elements may be broken or information stored in the information storage element may be rewritten by static electricity.

In the inkjet recording head disclosed in Japanese Patent Laid-Open No. 7-060953, an adverse influence of static electricity can be avoided, but it is necessary to form a special discharging circuit on the substrate. For this reason, various improvements are expected to enhance the space efficiency and to reduce the size and cost of the head.

SUMMARY OF THE INVENTION

The present invention is directed to a liquid-discharging recording head having a simple configuration and including an information storage element that is capable of storing individual information about the head and that is resistant to static electricity, and provides a liquid-discharging recording apparatus including the head.

In one aspect of the present invention, a liquid-discharging recording head includes a plurality of contact pads provided on a first face and a second face that defines an outer surface of the liquid-discharging recording head; and an information storage element configured to store externally readable information. The first face is recessed so as to be lower than the second face with respect to the outer surface. The contact pads include an information output contact pad directly connected to the information storage element, and the information output contact pad is disposed on the first face.

Further features of the present invention will become apparent from the following description of exemplary embodiments with reference to the attached drawings.

DESCRIPTION OF THE EMBODIMENTS

Embodiments of the present invention will be described below with reference to the drawings.

First Embodiment

Figure 3B:
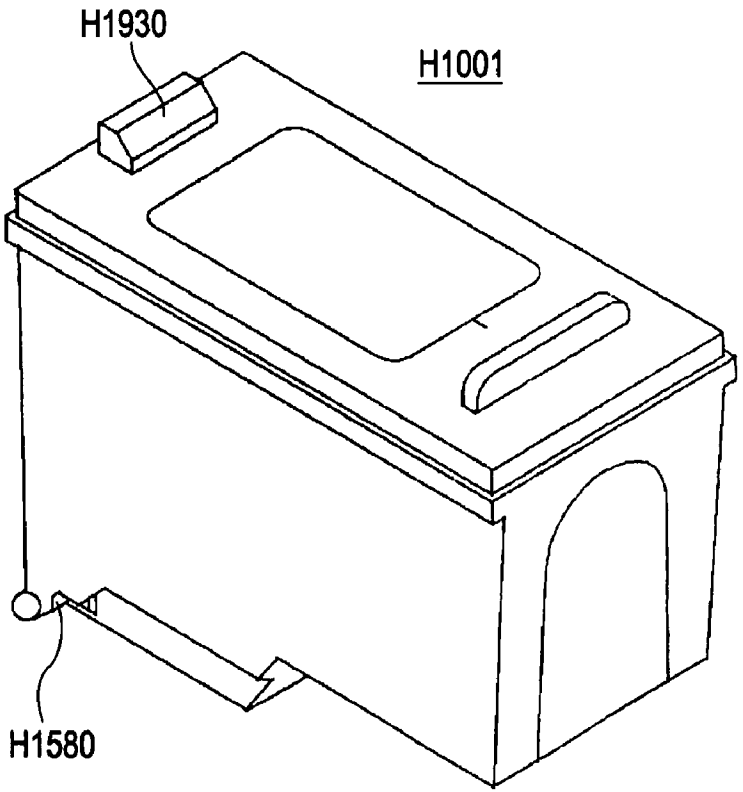
FIGS. 3A and 3B are perspective views of the inkjet recording head, respectively, as viewed from a recording-element substrate and from a cover.
Figure 3A:
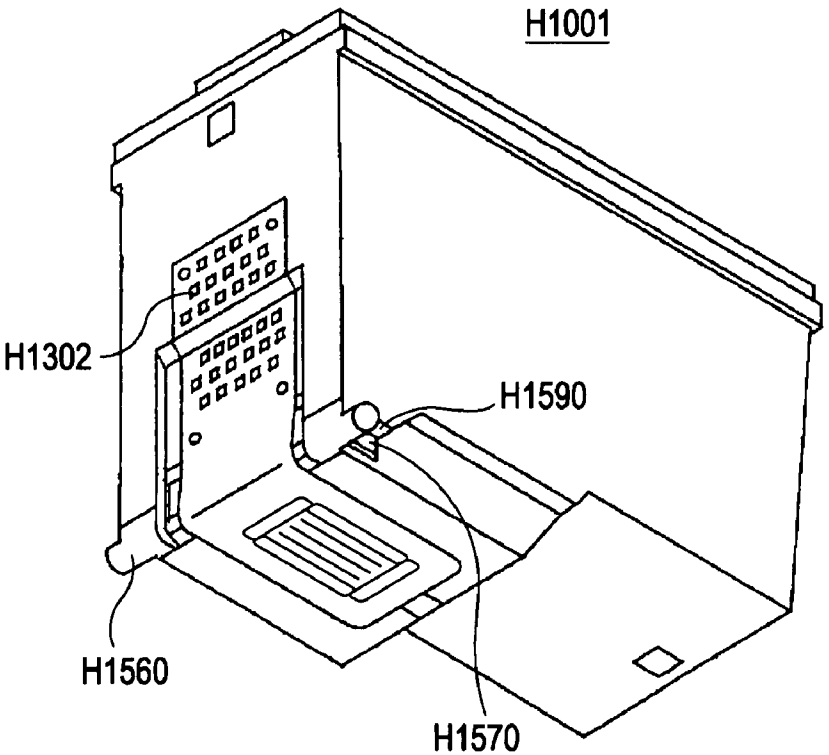
Figure 4:
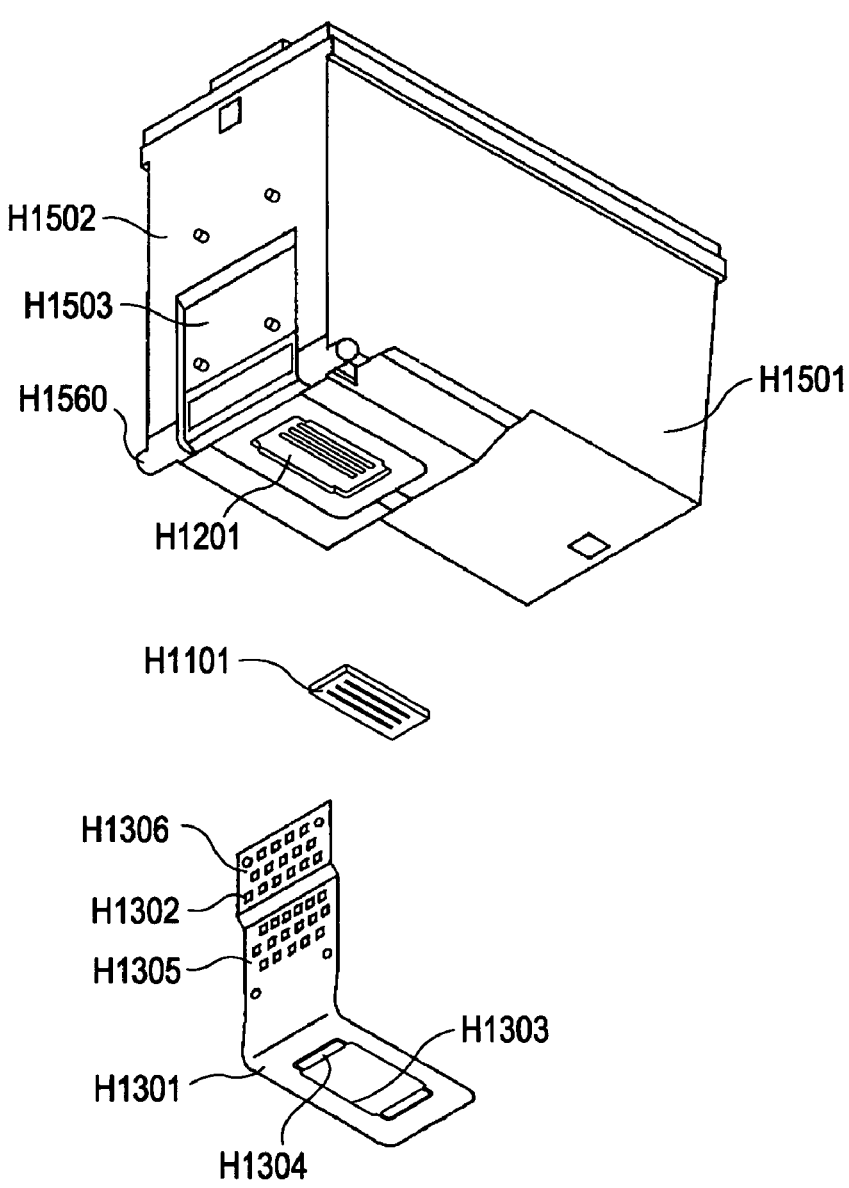
FIG. 4 is an exploded perspective view of the inkjet recording head.

FIGS. 3A, 3B and 4 show a recording head (liquid-discharging recording head) H1001 according to a first embodiment of the present invention.

The recording head H1001 discharges inks of three colors (cyan, magenta, and yellow) and incorporates an ink tank serving as an ink storage containing the inks. As will be described below, the recording head H1001 is detachably mounted on a carriage installed in a main unit of an inkjet recording apparatus, and is replaceable with a new recording head when ink contained therein runs out.

The recording head H1001 includes a recording-element substrate (liquid discharging mechanism section) H1101 that constitutes an ink discharging mechanism, as shown by FIG. 4 as an exploded perspective view. The recording-element substrate H1101 is mounted on an ink supply and storage unit H1501 that defines an ink supply path from the ink storage to the recording-element substrate H1101. An electrical wiring tape H1301 is also mounted on the ink supply and storage unit H1501 to electrically connect the recording-element substrate H1101 to the carriage.

The configurations of the recording head H1001 and the recording apparatus including the recording head H1001 will be described in more detail below.

(1) Recording-Element Substrate H1101

Figure 5:
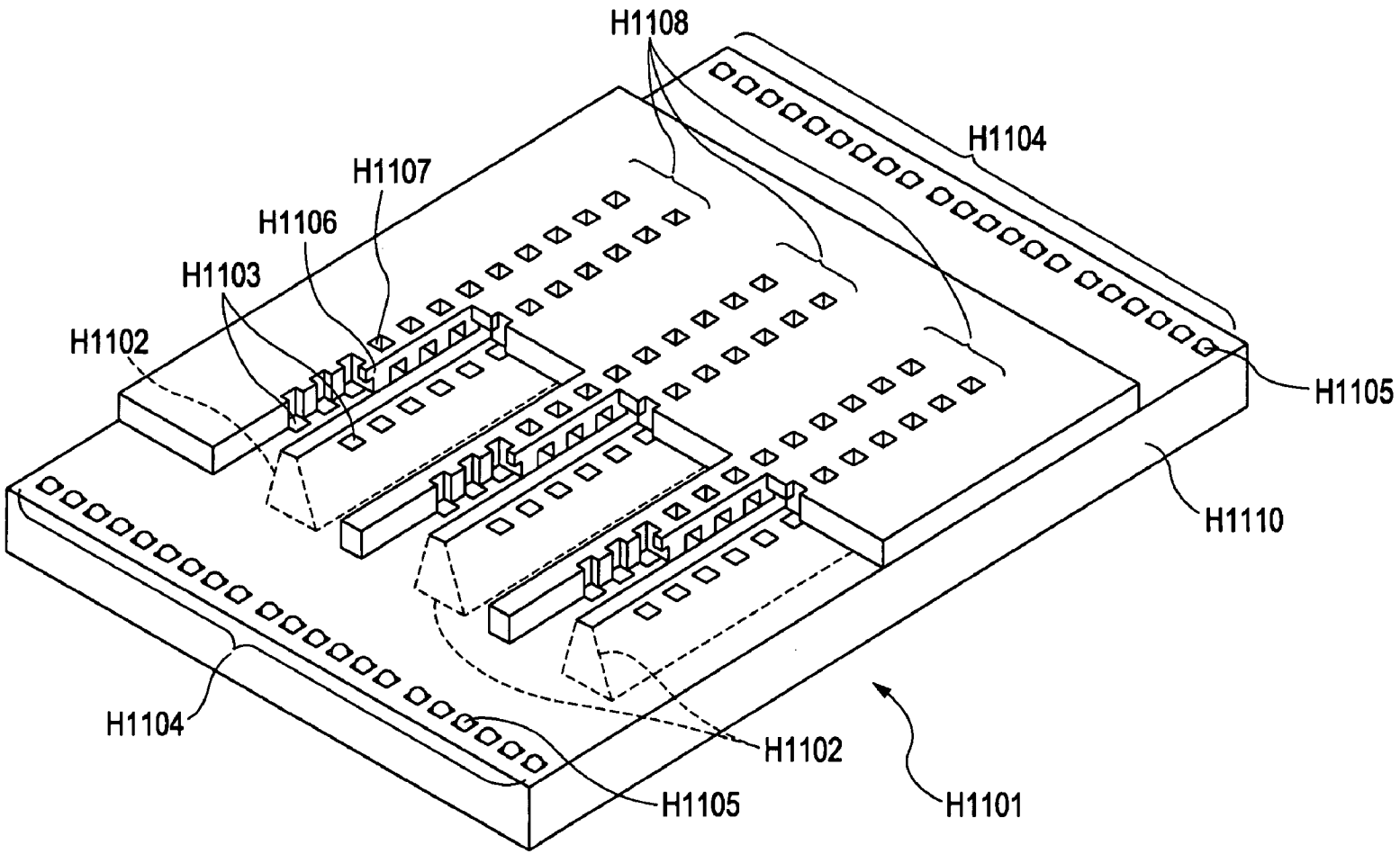
FIG. 5 is a partly cutaway perspective view of the recording-element substrate in the inkjet recording head.

FIG. 5 is a partly cutaway perspective view showing the configuration of the recording-element substrate H1101.

The recording-element substrate H1101 forms an ink discharging structure using an inkjet method in which electrothermal transducers (recording elements) H1103 generate heat energy to cause film boiling in the ink according to electrical signals. In the ink discharging structure, the electrothermal transducers H1103 oppose discharging outlets H1108, respectively.

The recording-element substrate H1101 includes a silicon (Si) substrate H1110 having a thickness of, for example, 0.5 to 1 mm. Three ink supply openings H1102 for cyan, magenta, and yellow extend in parallel on the Si substrate H1110. The ink supply openings H1102 are long through grooves, and can be formed, for example, by anisotropic etching using Si crystal orientation or by sand blasting.

On the Si substrate H1110, rows of electrothermal transducers 1103 are provided on either side of each ink supply opening H1102. An electrical circuit (not shown) is also provided on the Si substrate H1110, and includes, for example, aluminum electric wires for supplying power to the electrothermal transducers H1103. The electrothermal transducers H1103 and the electrical circuit can be formed by a known film deposition technique.

Electrodes H1104 are also provided on the Si substrate H1110 to supply power from the outside to the electrical circuit and to supply electrical signals for driving the electrothermal transducers H1103 from the outside. The electrodes H1104 are arranged along side edges of the Si substrate H1110 and at both ends of the rows of electrothermal transducers H1103. Each of the electrodes H1104 has a bump H1105 made of, for example, gold (Au).

A resin structure formed by photolithography is disposed on a portion of the Si substrate H1110 on which the electrothermal transducers H1103 and the electrical circuit are provided. The structure includes ink channel walls H1106 that define ink channels extending from the ink supply openings H1102 to the electrothermal transducers H1103, and a ceiling portion that covers the ink channels. Discharging outlets H1107 are provided in the ceiling portion so as to oppose the electrothermal transducers H1103, thereby forming discharging outlet groups H1108 corresponding to the colors. Ink supplied from each ink supply opening H1102 is selectively discharged from the discharging outlets H1107 opposing the electrothermal transducers H1103 by the pressure of bubbles produced by heat from the electrothermal transducers H1103.

Figure 6:
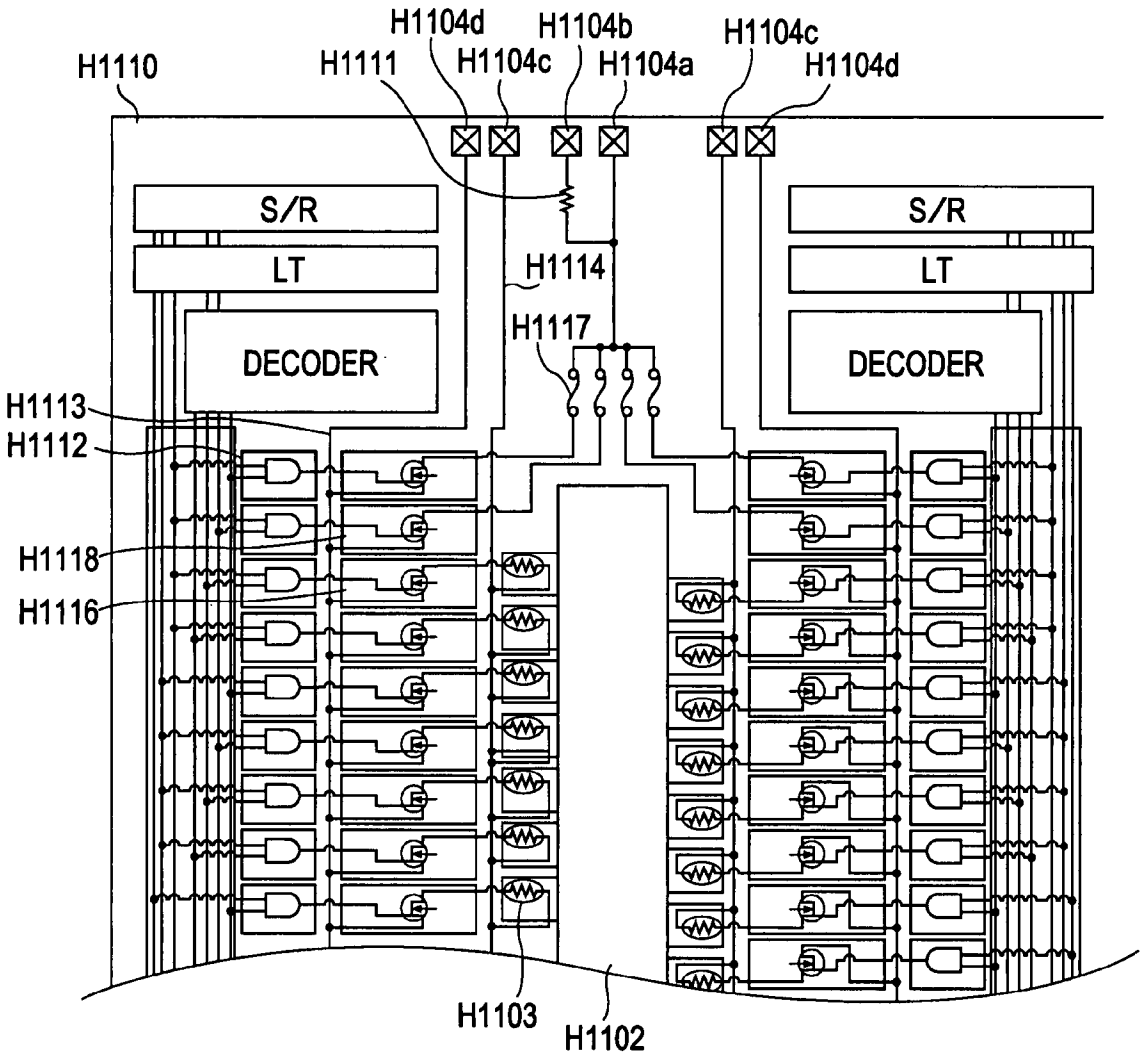
FIG. 6 is a schematic view of a circuit provided on the recording-element substrate shown in FIG. 5.

The electrical circuit provided on the Si substrate H1110 will now be described with reference to FIG. 6 as a schematic view.

One-end portions of the electrothermal transducers H1103 in each row are connected via a VH line H1114 to a VH pad H1104*c* for supplying VH power, and the other-end portions thereof are respectively connected to first driving elements H1116. A GNDH pad H1104*d* for supplying GNDH power is connected to the first driving elements H116 via a GNDH line H1113. The first driving elements H1116 drive the electrothermal transducers H1103 according to signals that are input from the outside of the recording-element substrate H1101 via a signal line, a shift register (S/R), a latch circuit (LT), a decoder, and selection circuits H1112.

The circuit on the Si substrate H1110 is connected to fuses H1117 serving as information storage elements that store information inherent in the head. In the first embodiment, four fuses H1117, each made of a polysilicon resistor, are arranged beside a short side of each ink supply opening H1102.

The fuses H1117 are connected at one end to an ID pad H1104*a*, and to an ID power pad H1104*b* via a reading resistor H1111. The fuses H1117 are connected at the other end to second driving elements H1118 that are used to selectively blow out the fuses H1117 and to selectively read out information obtained depending on whether the fuses H1117 are blown out.

The second driving elements H1118 are provided adjacent to the first driving elements H1116 for driving the electrothermal transducers H1103, and are connected to a selection-signal generating circuit having a structure similar to that of a selection-signal generating circuit for the first driving elements H1116. In the first embodiment, the first driving elements H1116 and the second driving elements H1118 share the S/R, the LT, and the decoder. Therefore, operations of both the driving elements can similarly be controlled according to signals input from the outside via a common signal line. The GNDH line H1113 connected to the first driving elements H1116 is also connected to the second driving elements H1118. That is, the first driving elements H1116 and the second driving elements H1118 also share the GNDH line H1113.

Pads via which external signals are input to the pads H1104*a* to H1104*d* and the selection-signal generation circuits of the first and second driving elements H1116 and H1118 correspond to the bumps H1105 (FIG. 5) of the electrodes H1104.

Blowout of the fuses H1117 and information reading from the fuses H1117 will now be described.

In order to blow out a desired fuse H1117, a fuse blowout power source is connected to the ID pad H1104*a*, and a voltage that can blow out the fuse H1117 (for example, 24V as a driving voltage for the electrothermal transducers H1103) is applied. The second driving element H1118 corresponding to the fuse H1117 is thereby driven via the selection circuit H1112, and the fuse H1117 is blown out in an extremely short time (instantaneously). In this case, the ID power pad H1104*b* serving as the fuse reading power terminal is opened.

In order to read information, a reading power source is connected to the ID power pad H1104*b*, and a voltage (for example, 3.3 V as a power voltage for the logic circuit) is applied to drive the second driving element H1118. In this case, when the corresponding fuse H1117 has been blown out, a high-level signal is output to the ID pad H1104*a*. Conversely, when the corresponding fuse H1117 has not been blown out, a low-level signal is output to the ID pad H1104*a* because the reading resistor H1111 has a resistance that is clearly higher than the resistance of the fuse H1117.

As the information storage elements that store information inherent in the head, the above-described fuses H1117 may be replaced by lines provided on the Si substrate H1110 so that information is held depending on the presence or absence of the lines. In this case, information is written by selectively forming lines on the Si substrate H1110 in accordance with information inherent in the head. Therefore, it is impossible to add another information later. Information reading can be performed in the same manner as that employed when the above-described fuses H1117 are used.

Alternatively, a resistor element having a resistance in accordance with information inherent in the head may be provided on the Si substrate H1110, and the resistor element may be connected at one end to the ID pad H1104*a*, and connected at the other end to the GNDH pad H1104*d*. In this case, the main unit of the inkjet recording apparatus reads the resistance between the ID pad H1104*a* and the GNDH pad H1104*d*, thereby obtaining the information inherent in the head corresponding to the resistance.

(2) Electrical Wiring Tape H1301

Referring again to FIGS. 3A, 3B and 4, the electrical wiring tape H1301 forms an electrical-signal path for connecting the bumps H1105 of the electrodes H1104 on the recording-element substrate H1101 to an electrical connecting portion of the carriage. Electrical signals for discharging ink and electrical signals for reading the above-described information inherent in the head are exchanged between the main unit of the recording apparatus and the recording-element substrate H1101 via the electrical-signal path. For example, the electrical wiring tape H1301 can be formed by a wiring pattern of copper foil on a base material of polyimide.

An opening H1303 is provided at one end of the electrical wiring tape H1301 so that an ink discharging surface of the recording-element substrate H1101 is exposed therefrom. Electrical terminals H1304 are provided near the edges of the opening H1303 so as to be connected to the electrodes H1104 on the recording-element substrate H1101. The electrical wiring tape H1301 and the recording-element substrate H1101 are electrically connected, for example, by electrically joining the bumps H1105 of the electrodes H1104 on the recording-element substrate H1101 to the corresponding electrode terminals H1304 of the electrical wiring tape H1301 by ultrasonic thermo compression bonding.

A plurality of external-signal input terminals (contact pads) H1302 are provided at the other end of the electrical wiring tape H1301 so as to be connected to the electrical connecting portion of the carriage in the main unit of the recording apparatus. A portion of the electrical wiring tape H1301 having the external-signal input terminals H1302 is mounted in a stepped portion defined by side faces H1502 and H1503 of the ink supply and storage unit H1501. The portion of the electrical wiring tape H1301 includes a lower first face H1305 and a higher second face H1306 provided parallel to the first face H1305. The external-signal input terminals H1302 and the electrode terminals H1304 are connected by a continuous wiring pattern made of copper foil.

(3) Ink Supply and Storage Unit H1501

The ink supply and storage unit H1501 can be formed by, for example, resin molding.

An ink supply opening H1201 is provided downstream from the ink channel in the ink supply and storage unit H1501 to supply cyan, magenta, and yellow inks to the recording-element substrate H1101. The recording-element substrate H1101 is bonded and fixed to the ink supply and storage unit H1501 with high positioning accuracy so that the ink supply openings H1102 communicate with the ink supply opening H1201 of the ink supply and storage unit H1501.

A portion around the opening H1303 on the back surface of the electrical wiring tape H1301 is bonded and fixed to a raised flat portion of the ink supply and storage unit H1501 around the ink supply opening H1201. A portion of the electrical wiring tape H1301 extending from the side of the opening H1303 is bent, and is fixed, for example, by caulking or bonding, to the stepped portion defined by the side faces H1502 and H1503 that are substantially orthogonal to the face of the ink supply and storage unit H1501 having the ink supply opening H1201.

A description will now be given of loading the above-described recording head H1001 in the inkjet recording apparatus.

The recording head H1001 can be easily led to a predetermined loading position on the carriage while loading guides H1560 are placed in contact with corresponding portions of the carriage. When the recording head H1001 reaches the loading position on the carriage, abutting portions H1570, H1580, and H1590 abut corresponding positioning portions of the carriage. As a result, the recording head H1001 is precisely positioned at the predetermined loading position. Further, the recording head H1001 is fixed to the carriage by moving a fixing lever of the carriage so as to be engaged with an engaging portion H1930 of the recording head H1001.

In this way, the recording head H1001 can be precisely fixed at the predetermined loading position on the carriage, and the external-signal input terminals H1302 of the electrical wiring tape H1301 can be placed in precise contact with the contact pins serving as electrical contacts in the electrical connecting portion of the carriage. Consequently, recording signals and source power are supplied from the inkjet recording apparatus to the recording head H1001 via the electrical wiring tape H1301.

(4) Inkjet Recording Apparatus

Figure 7:
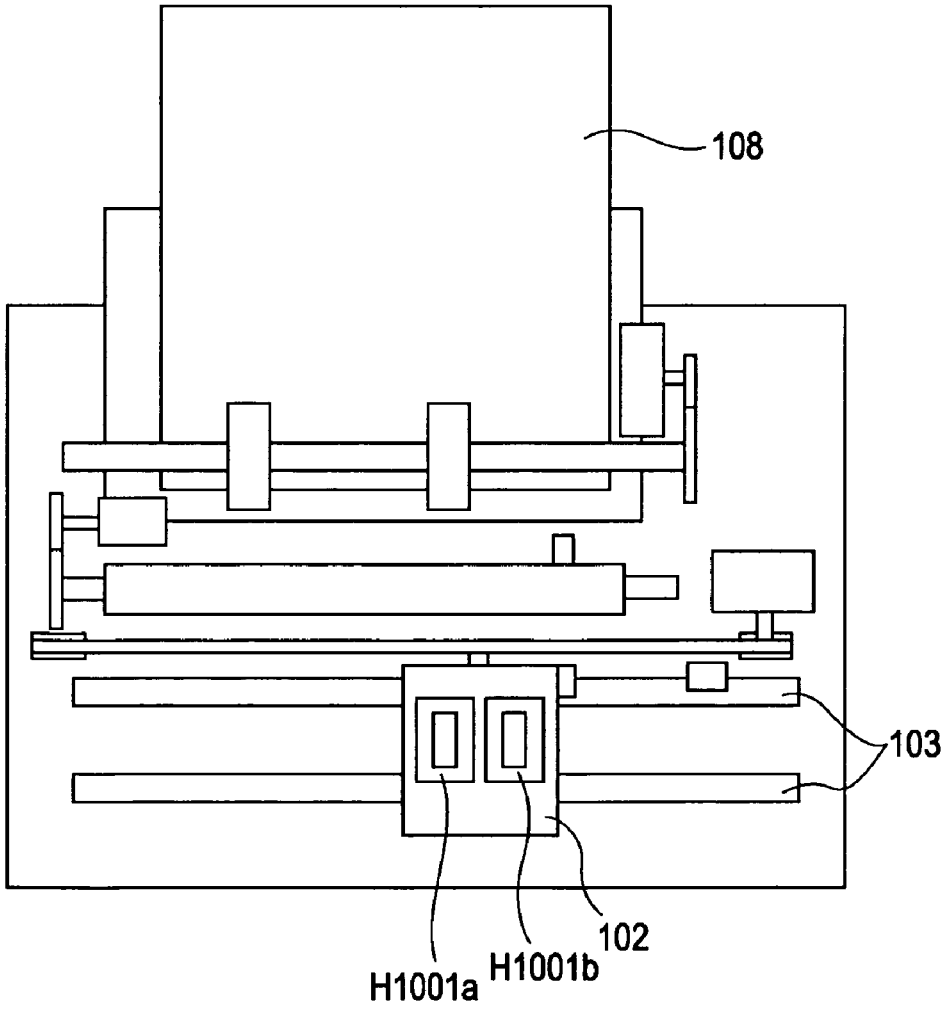
FIG. 7 is a schematic view of an inkjet recording apparatus in which the inkjet recording head shown in FIG. 1 can be loaded.

An inkjet recording apparatus in which the above-described recording head H1001 can be loaded will now be described with reference to FIG. 7.

The inkjet recording apparatus includes a carriage 102 in which two replaceable recording heads H1001*a* and H1001*b*, similar to those shown in FIG. 3, are loaded in position. For example, one of the H1001*a* and H1001*b* may be used to discharge inks of three colors (cyan, magenta, and yellow) and the other may be used to discharge black ink.

The carriage 102 is supported so as to reciprocate along guide shafts 103 extending in the main scanning direction in the main unit of the apparatus.

The inkjet recording apparatus also includes an automatic sheet feeder (ASF) that separates and supplies recording media 108, such as sheets of paper or plastic sheets, one by one. The ASF includes pickup rollers that are rotated by a supply motor via gears.

In a printing section, a platen (not shown) is provided to support a back surface of a recording medium 108 so that a printing surface of the recording medium 108 can be placed in a flat position in the printing section. The recording heads H1001*a* and H1001*b* are held on the carriage 102 so that discharging faces thereof protrude downward from the carriage 102 and are parallel to the printing surface of the recording medium 108 on the platen. The discharging outlets H1007 of the discharging outlet groups H1108 in the recording heads H1001*a* and H1001*b* are arranged in a direction orthogonal to the scanning direction of the carriage 102.

In this inkjet recording apparatus, while the carriage 102 reciprocates, the recording heads H1001*a* and H1001*b* are driven at timings determined in accordance with a desired recording image to selectively discharge ink from the discharging outlets H1107, thus recording the image in a predetermined region on the recording medium 108.

(5) Structure for Protecting Information Storage Elements from Electrostatic Damage Static protection of the information storage elements that store information inherent in the recording head H1001 in the first embodiment will now be described with reference to FIGS. 1 and 2.

Figure 1:
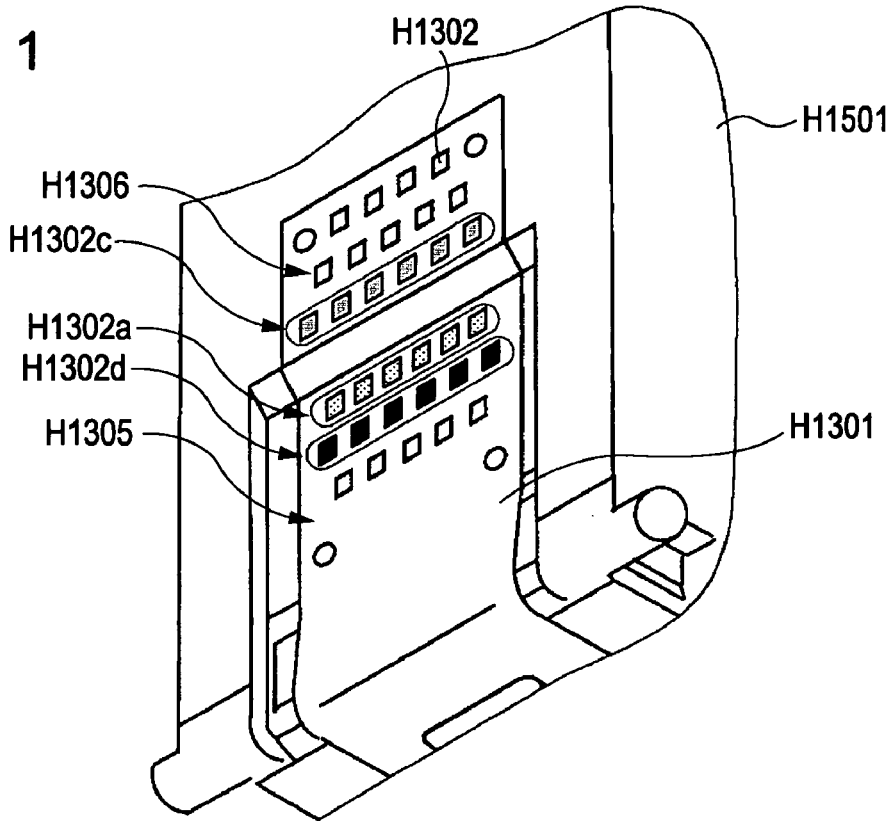
FIG. 1 is an explanatory view of a section of an inkjet recording head according to a first embodiment of the present invention in which external-signal input terminals are provided.
Figure 2:
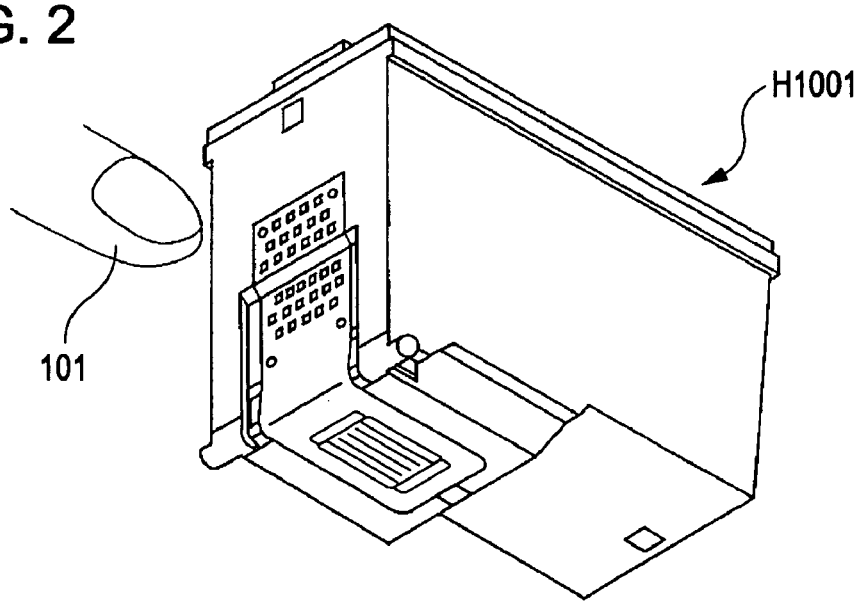
FIG. 2 is an explanatory view showing a state in which a finger of a user is brought close to the inkjet recording head shown in FIG. 1.

FIG. 1 is an enlarged view of a portion of the recording head H1001 in which the external-signal input terminals H1302 are provided. The electrical wiring tape H1301 includes thirty-two external-signal input terminals H1302. Seventeen of the external-signal input terminals H1302 are provided on the recessed first face H1305, and fifteen remaining external-signal input terminals H1302 are provided on the second face H1306. The first face H1305 is provided on the lower side of the second face H1306 in the figure and is recessed below the second face H1306.

Six of the external-signal input terminals H1302 serve as ID contact pads (information output contact pads) H1302*a*. The ID contact pads H1302*a* are provided on the first face H1305 along the border with the second face H1306. The ID contact pads H1302*a* are connected to the ID pads H1104*a* connected to the fuses H1117 (or connecting wires, resistors) shown in FIG. 6. Therefore, the ID contact pads H1302*a* are directly connected to the information storage elements not via other elements.

Another six of the external-signal input terminals H1302 serve as GNDH contact pads (ground contact pads) H1302*d*, and are arranged in a row adjacent to the row of the ID contact pads H1302*a*. The GNDH contact pads H1302*d* are connected to the GNDH pads H1104*d* shown in FIG. 6.

Six VH contact pads (power-supply contact pads) H1302*c* are arranged in a row on the second face H1306 adjacent to the row of ID contact pads H1302*a* and along the border with the first face H1305. The VH contact pads H1302*c* are connected to the VH pads H1104*c* shown in FIG. 6.

The external-signal input terminals H1302 other than the ID contact pads H1302*a*, the VH contact pads H1302*c*, and the GNDH contact pads H1302*d* are used for various applications, for example, for transistor power supply and control signals.

The recording head H1101 is handled by the user when it is taken out of the apparatus because the stored ink is depleted and when a recording head for forming an image of normal quality and a recording head for forming a photo image with higher definition are exchanged according to the application. In this case, the user may inadvertently bring a charged finger 101 close to the external-signal input terminals H1302, as shown in FIG. 2.

In the first embodiment, the ID contact pads H1302*a* connected to the information storage elements (fuses H1117, which are more easily affected by static electricity than the elements such as the electrothermal transducers H1103) are arranged on the recessed first face H1305. Therefore, even when the user brings the finger 101 close to the external-signal input terminals H1302, the finger 101 does not easily touch the ID contact pads H1302*a*. In particular, since the ID contact pads H1302*a* are provided on the first face H1305 and along the border with the second face H1306, the stepped portion provided between the first and second faces H1305 and H1306 can effectively prevent the finger 101 from touching the ID contact pads H1302*a*. By thus preventing the finger 101 from touching the ID contact pads H1302*a*, the fuses H1101 are less susceptible to static electricity via the ID contact pads H1302*a*.

In addition, the ID contact pads H1302*a* are provided adjacent to and between the VH contact pads H1302*c* and the GNDH contact pads H1302*d*. For this reason, even when electrical discharging is caused by the charged finger 101 placed close to the ID contact pads H1302*a*, electrical discharging is likely to occur in the VH contact pads H1302*c* and the GNDH contact pads H1302*d*. Therefore, the fuses H1101 are less affected by static electricity. Electrical discharging easily occurs in the VH contact pads H1302*c* and the GNDH contact pads H1302*d*, for example, because these contact pads are configured to supply power to the electrothermal transducers H1103 and electricity relatively easily flows therethrough. Further, from the viewpoint of arrangement, the surface of the finger can be more easily brought close to the VH contact pads H1302*c* and the GNDH contact pads H1302*d* than the ID contact pads H1302*a*.

As described above, according to the first embodiment, the information storage elements for storing information inherent in the head can be prevented from being affected by static electricity. Consequently, it is possible to prevent the information storage elements from being broken by static electricity and to prevent the head inherent information stored in the information storage elements from being rewritten undesirably. In the first embodiment, the information storage elements can be protected from static electricity without using a special circuit, complicating the structure of the recording head H1001, and increasing the number of manufacturing processes of the recording head H1001. That is, the information storage elements in the recording head H1001 can be made resistant to static electricity with a simple configuration.

Second Embodiment

Figure 8:
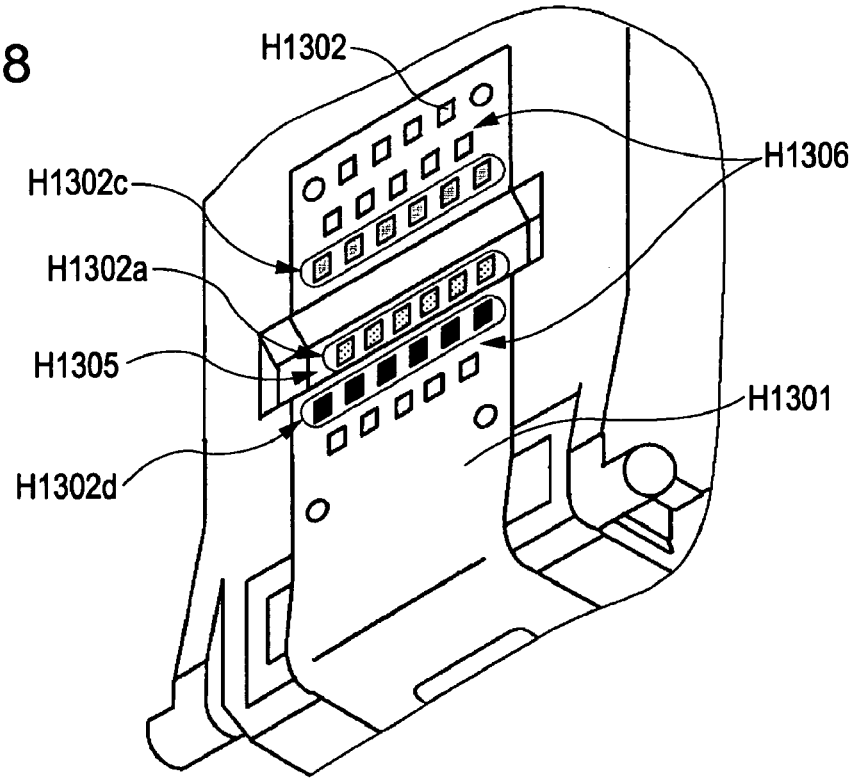
FIG. 8 is an explanatory view of a section of an inkjet recording head according to a second embodiment of the present invention in which external-signal input terminals are provided.

A recording head H1001 according to a second embodiment of the present invention will be described with reference to FIG. 8. FIG. 8 is an enlarged view of a section of the recording head H1001 in which external-signal input terminals are provided. The recording head H1001 of the second embodiment is different from the first embodiment only in the arrangement of the external-signal input terminals. Other structures, such as a recording-element substrate, may be equivalent to those employed in the first embodiment.

Referring to FIG. 8, six ID contact pads H1302*a*, among thirty-two external-signal input terminals 1302 provided on an electrical wiring tape H1301, are provided on a recessed first face H1305. Twenty-six remaining external-signal input terminals H1302 are provided on second faces H1306. A row of six GNDH contact pads H1302*d* and a row of six VH contact pads H1302*c* are provided on the second faces H1306 so as to be adjacent to the upper and lower sides of the ID contact pads H1302*a*.

In the recording head H1001 of the second embodiment, the ID contact pads H1302*a* connected to fuses H1117 (or connecting wires, resistors), which form information storage elements that are relatively easily affected by static electricity, are provided on the recessed first face 1305. Further, the rows of the contact pads adjacent to the ID contact pads H1302*a* are provided on the second faces H1306 that are higher than the first face H1305. With this arrangement of the rows of pads, it is possible to more effectively prevent the user from touching the ID contact pads H1302*a* when handling the recording head H1001.

In addition, the VH contact pads H1302*c* and the GNDH contact pads H1302*d* are provided adjacent to the ID contact pads H1302*a*. For this reason, even when a charged finger of the user is inadvertently brought close to the ID contact pads H1302*a*, electrical discharging is likely to occur in the VH contact pads H1302*c* and the GNDH contact pads H1302*d*, but does not easily occur in the ID contact pads H1302*a*.

In this way, according to the second embodiment, it is possible to prevent the influence, such as breakage, of static electricity on the information storage elements, and undesirable rewriting of information inherent in the head which is stored in the information storage elements.

Third Embodiment

A recording head H1001 according to a third embodiment of the present invention will be described with reference to FIG. 9.

Figure 9:
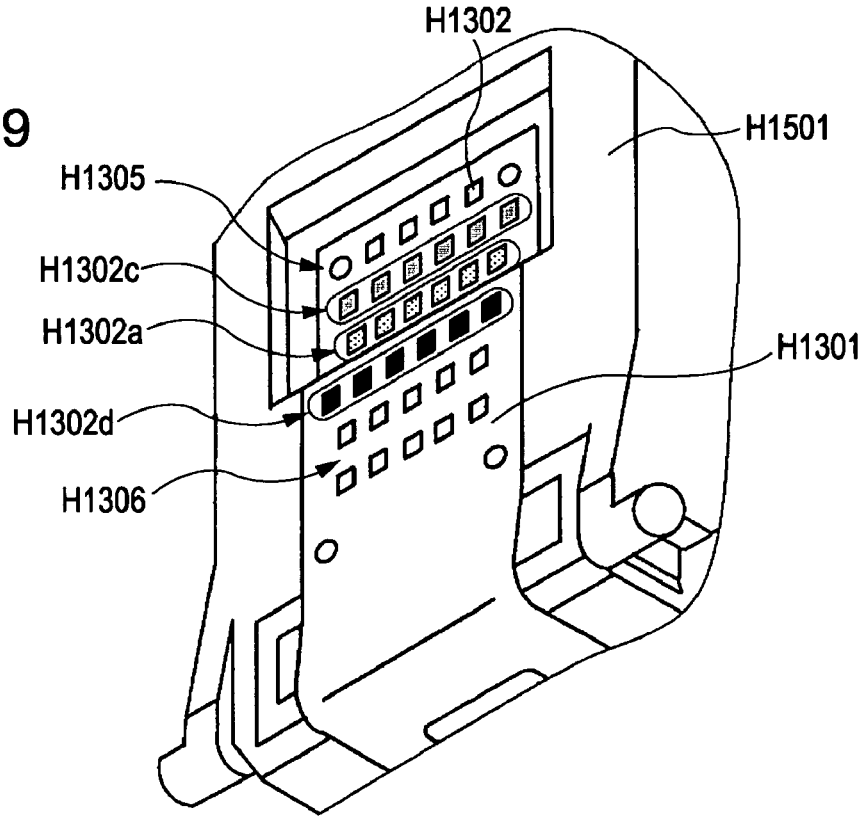
FIG. 9 is an explanatory view of a section of an inkjet recording head according to a third embodiment of the present invention in which external-signal input terminals are provided.

FIG. 9 is an enlarged view of a section of a recording head H1001 in which external-signal input terminals are provided. The recording head H1001 of the third embodiment is different from the recording heads of the first and second embodiments only in the arrangement of the external-signal input terminals. Other structures, such as a recording-element substrate, may be equivalent to those employed in the first embodiment.

Referring to FIG. 9, sixteen external-signal input terminals H1302, among thirty-two external-signal input terminals H1302 provided on an electrical wiring tape H1301, are provided on a recessed first face H1305. Sixteen remaining external-signal input terminals H1302 are provided on a second face H1306. The first face H1305 is disposed on the upper side of the second face H1306 in the figure.

Six ID contact pads H1302*a* of the external-signal input terminals H1302 are arranged in a row in the lowermost part of the first face H1305, that is, along the border between the first face H1305 and the second face H1306. A row of six VH contact pads H1302*c* and a row of six GNDH contact pads H1302*d* are respectively provided on the upper and lower sides of the row of ID contact pads H1302*a*. Therefore, the row of GNDH contact pads H1302*d* is provided on the uppermost part of the second face H1306 and along the border with the first face H1305.

In the third embodiment, the ID contact pads H1302*a* connected to information storage elements (e.g., fuses H1117, connecting wires, or resistors), which are relatively easily affected by static electricity, are provided on the recessed first face H1305, in a manner similar to that employed in the first embodiment. For this reason, when the user handles the recording head H1001, it is not easy for the user to touch the ID contact pads H1302*a*. In addition, the row of ID contact pads H1302*a* is disposed between the adjacent rows of the VH contact pads H1302*c* and the GNDH contact pads H1302*d*. Therefore, even when a charged finger of the user is inadvertently placed close to the ID contact pads H1302*a* and electrical discharging occurs, the discharging is likely to occur in the VH contact pads H1302*c* and the GNDH contact pads H1302*d*, but does not easily occur in the ID contact pads H1302*a*. Consequently, according to the third embodiment, it is possible to prevent breakage of the information storage elements by static electricity, and undesirable rewriting of information inherent in the head which is stored in the information storage elements.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions. According to the embodiments of the present invention, the information storage elements can be prevented from being broken by static electricity that may be produced during attachment or detachment of the head, and information stored in the information storage elements can be prevented from being rewritten into unintended information by improving the shape of the head or the housing for holding the head without using a special circuit.

This application claims the benefit of Japanese Application No. 2005-116666 filed Apr. 14, 2005, which is hereby incorporated by reference herein in its entirety.

What is claimed is:

1. A liquid-discharging recording head comprising:

a plurality of contact pads provided on a first face and a second face that defines an outer surface of the liquid-discharging recording head; and an information storage element configured to store externally readable information, wherein the first face is recessed so as to be lower than the second face with respect to the outer surface, wherein the contact pads include an information contact pad directly connected to the information storage element, and the information contact pad being disposed on the first face, and wherein the information storage element is cut off in response to an external electrical signal.

2. A liquid-discharging recording apparatus, comprising:

a liquid-discharging recording head; and a plurality of electrical contacts supplying an electrical signal to the liquid-discharging recording head, wherein the liquid-discharging recording head includes:

a plurality of contact pads provided on a first face and a second face that defines an outer surface of the liquid-discharging recording head, the contact pads being in contact with the electrical contacts; and an information storage element configured to store information that is readable from the liquid-discharging recording apparatus, wherein the first face is recessed so as to be lower than the second face with respect to the outer surface, wherein the contact pads include an information contact pad directly connected to the information storage element, and the information contact pad being disposed on the first face, and wherein the information storage element is cut off in response to an external electrical signal.

* * * * *